US008414275B1

(12) United States Patent
Davis

(10) Patent No.: US 8,414,275 B1
(45) Date of Patent: Apr. 9, 2013

(54) PUMP AND VALVE COMBINATION FOR AN ARTICLE OF FOOTWEAR INCORPORATING AN INFLATABLE BLADDER

(75) Inventor: Paul M. Davis, Blackstone, MA (US)

(73) Assignee: Reebok International Limited, London (GB)

( * ) Notice: Subject to any disclaimer, the term of this patent is extended or adjusted under 35 U.S.C. 154(b) by 1663 days.

(21) Appl. No.: 11/622,180

(22) Filed: Jan. 11, 2007

(51) Int. Cl.
*F04B 43/00* (2006.01)
*F04B 45/02* (2006.01)

(52) U.S. Cl. ..... 417/472; 36/29; 36/35 B

(58) Field of Classification Search ..... 417/441, 417/472, 559, 566; 36/29, 3 B, 35 B
See application file for complete search history.

(56) References Cited

U.S. PATENT DOCUMENTS

| | | | | |
|---|---|---|---|---|
| 508,034 | A | | 11/1893 | Moore |
| 547,645 | A | | 9/1895 | MacDonald |
| 566,422 | A | | 8/1896 | Singleton |
| 580,501 | A | | 4/1897 | Mobberley |
| 586,155 | A | | 7/1897 | Bascom |
| 850,327 | A | | 4/1907 | Tauber |
| 1,069,001 | A | | 7/1913 | Guy |
| 1,148,376 | A | | 7/1915 | Gay |
| 1,193,608 | A | | 8/1916 | Poulson |
| 1,198,476 | A | | 9/1916 | Pearson |
| 1,304,915 | A | | 5/1919 | Spinney |
| 1,328,154 | A | | 5/1920 | Jackerson |
| 1,498,838 | A | | 6/1924 | Harrison, Jr. |
| 1,605,985 | A | | 11/1926 | Rasmussen |
| 1,954,122 | A | | 4/1934 | Fiori |
| 1,979,972 | A | | 11/1934 | Guild |
| 2,007,803 | A | | 7/1935 | Kelly |
| 2,020,240 | A | | 11/1935 | Cochran |
| 2,036,695 | A | | 4/1936 | Heigis |
| 2,080,469 | A | | 5/1937 | Gilbert |
| 2,080,499 | A | | 5/1937 | Nathansohn |
| 2,177,116 | A | | 10/1939 | Persichino |
| 2,488,382 | A | | 11/1949 | Davis |
| 2,532,742 | A | * | 12/1950 | Stoiner ..... 36/35 B |
| 2,600,239 | A | | 6/1952 | Gilbert |
| 2,605,560 | A | | 8/1952 | Gouabault |
| 2,638,690 | A | | 5/1953 | Bullard, III |
| 2,677,904 | A | | 5/1954 | Reed |
| 2,682,712 | A | | 8/1954 | Cooksley |

(Continued)

FOREIGN PATENT DOCUMENTS

| | | |
|---|---|---|
| BR | 8305004 | 9/1983 |
| DE | 3427644 | 1/1986 |

(Continued)

*Primary Examiner* — Peter J Bertheaud
(74) *Attorney, Agent, or Firm* — Sterne, Kessler, Goldstein & Fox P.L.L.C.

(57) ABSTRACT

An article of footwear having a pump and valve combination for inflating an inflatable bladder. In one embodiment the pump and valve combination has a pumping area formed between top and bottom polymeric films with a foam insert located therein and an air intake hole leading into the pumping area. A conduit leads from the pumping area to an inflatable bladder and a flow restrictor is located in a pathway of the conduit. In a second embodiment the pump and valve combination has a pumping area formed between top and bottom polymeric films and a grommet. An air intake is located in the pumping area. The grommet has an exhaust hole and a flexible band arranged around the grommet, including the exhaust hole.

7 Claims, 6 Drawing Sheets

U.S. PATENT DOCUMENTS 2,717,100 A 9/1955 Engelder
2,774,152 A 12/1956 Alber
2,863,230 A 12/1958 Cortina
2,981,010 A 4/1961 Aaskov
3,015,414 A 1/1962 Wilson
3,027,659 A 4/1962 Gianola
3,044,190 A 7/1962 Urbany
3,068,494 A * 12/1962 Pinkwater ..... 5/708
3,120,712 A 2/1964 Menken
3,133,696 A * 5/1964 Mirando ..... 417/479
3,221,932 A 12/1965 Anderson
3,225,463 A 12/1965 Burnham
3,331,146 A 7/1967 Karras
3,372,495 A 3/1968 Finn
3,410,004 A 11/1968 Finn
3,664,043 A 5/1972 Polumbus, Jr.
3,685,176 A 8/1972 Rudy
3,716,930 A 2/1973 Brahm
3,744,159 A 7/1973 Nishimura
3,760,056 A 9/1973 Rudy
3,854,228 A 12/1974 Conroy
3,973,336 A 8/1976 Ah
3,995,653 A 12/1976 Mackal et al.
4,014,048 A 3/1977 Rappleyea
4,106,222 A 8/1978 Houck
4,129,951 A 12/1978 Petrosky
4,169,353 A 10/1979 Fresard
4,217,705 A 8/1980 Donzis
4,219,945 A 9/1980 Rudy
4,232,459 A 11/1980 Vaccari
4,271,606 A 6/1981 Rudy
4,361,969 A 12/1982 Vermonet
4,397,104 A 8/1983 Doak
4,417,407 A 11/1983 Fukuoka
4,446,634 A 5/1984 Johnson et al.
4,458,430 A 7/1984 Peterson
4,462,171 A 7/1984 Whispell
4,571,853 A 2/1986 Medrano
4,610,099 A 9/1986 Signori
4,628,945 A 12/1986 Johnson, Jr.
4,657,716 A * 4/1987 Schmidt ..... 264/45.7
4,662,087 A 5/1987 Beuch
4,662,412 A 5/1987 Swallert
4,670,995 A 6/1987 Huang
4,700,403 A 10/1987 Vacanti
4,702,022 A 10/1987 Porcher
4,730,403 A 3/1988 Walkhoff
4,744,157 A 5/1988 Dubner
4,760,651 A 8/1988 Pon-Tzu
4,763,426 A 8/1988 Polus et al.
4,776,110 A 10/1988 Shlang
4,805,601 A 2/1989 Eischen, Sr.
4,823,482 A 4/1989 Lakic
4,856,208 A 8/1989 Zaccaro
4,887,367 A 12/1989 Mackness et al.
4,906,502 A 3/1990 Rudy
4,910,889 A 3/1990 Bonaventure et al.
4,912,861 A 4/1990 Huang
D314,172 S 1/1991 Whitley, II
4,991,317 A 2/1991 Lakic
4,995,173 A 2/1991 Spier
5,025,575 A 6/1991 Lakic
5,074,765 A 12/1991 Pekar
5,083,581 A 1/1992 Jaw
5,113,599 A 5/1992 Cohen et al.
5,129,107 A 7/1992 Lorenzo
5,144,708 A 9/1992 Pekar
5,155,864 A 10/1992 Walker et al.
5,155,865 A 10/1992 Walker et al.
5,155,866 A 10/1992 Walker et al.
5,158,767 A 10/1992 Cohen et al.
5,181,279 A 1/1993 Ross
5,195,254 A 3/1993 Tyng
5,230,249 A 7/1993 Sasaki et al.
5,253,435 A 10/1993 Auger et al.
5,257,470 A 11/1993 Auger et al.
5,343,638 A 9/1994 Legassie et al.
5,351,710 A 10/1994 Phillips
5,353,525 A 10/1994 Grim
5,392,534 A 2/1995 Grim
5,406,661 A 4/1995 Pekar
5,416,988 A 5/1995 Potter et al.
5,444,926 A 8/1995 Allen et al.
5,549,452 A * 8/1996 Vogt ..... 417/199.1
5,638,565 A 6/1997 Pekar
5,692,321 A 12/1997 Holstine
5,765,298 A 6/1998 Potter et al.
5,771,606 A 6/1998 Litchfield et al.
5,806,208 A 9/1998 French
5,893,219 A 4/1999 Smith et al.
5,979,078 A 11/1999 McLaughlin
5,987,779 A 11/1999 Litchfield et al.
6,014,823 A 1/2000 Lakic
6,120,264 A * 9/2000 Wang ..... 417/480
6,127,010 A * 10/2000 Rudy ..... 428/35.7
6,134,812 A 10/2000 Voss
6,161,240 A 12/2000 Huang
6,195,914 B1 3/2001 Otis
6,237,251 B1 5/2001 Litchfield et al.
6,287,225 B1 9/2001 Touhey et al.
6,354,020 B1 3/2002 Kimball et al.
6,430,843 B1 8/2002 Potter et al.
6,505,420 B1 1/2003 Litchfield et al.
6,553,691 B2 4/2003 Huang
6,785,985 B2 9/2004 Marvin et al.
6,892,477 B2 5/2005 Potter et al.
6,988,329 B2 1/2006 Marvin et al.
7,047,670 B2 5/2006 Marvin et al.
7,051,456 B2 5/2006 Swigart et al.
7,152,625 B2 12/2006 Marvin et al.
7,210,249 B2 5/2007 Passke et al.
7,546,696 B1 * 6/2009 Acheson et al. ..... 36/29
2004/0211085 A1 10/2004 Passke et al.
2005/0028404 A1 2/2005 Marvin et al.
2005/0132617 A1 6/2005 Potter et al.
2006/0143943 A1 * 7/2006 Cho et al. ..... 36/3 B
2006/0162186 A1 7/2006 Marvin et al.
2006/0272179 A1 12/2006 Passke et al.
2007/0084082 A1 4/2007 Dojan et al.
2007/0084083 A1 4/2007 Hazenberg et al.

FOREIGN PATENT DOCUMENTS

EP 229273 7/1978
EP 40189 11/1981
EP 152401 8/1985
EP 184781 6/1986
EP 389215 9/1990
EP 472110 2/1992
EP 629360 12/1994
EP 630592 12/1994
FR 2496423 6/1982
GB 520514 12/1939
GB 2114425 8/1983
GB 2165439 4/1986
GB 2240254 7/1991
GB 2271710 4/1994
TW 95419 2/1989
WO WO 87/03789 7/1987
WO WO 89/10074 11/1989
WO WO 90/04323 5/1990
WO WO 91/18527 12/1991
WO WO 93/14659 8/1993
WO WO 93/21790 11/1993

* cited by examiner

PUMP AND VALVE COMBINATION FOR AN ARTICLE OF FOOTWEAR INCORPORATING AN INFLATABLE BLADDER

FIELD OF THE INVENTION

The present invention relates generally to a pump and valve combination for an inflatable article and, more particularly, to a pump and valve combination for an article of footwear incorporating an inflatable bladder and an article of footwear containing the same.

BACKGROUND OF THE INVENTION

Good fit, cushioning and shock absorption are challenges facing footwear designers. Inflatable articles have been used in the upper, under the foot, or within the sole of a shoe to enhance a shoe's fit, to provide cushioning and to help absorb shock while standing, walking or running. Inflatable products are particularly desirable for footwear because they are lightweight and can be adjustable to accommodate the particular cushioning, support or fit desired by the wearer.

Some inflatable bladders are inflated at the factory, while others have valves for which to attach inflation mechanisms, such that the individual wearer may adjust the pressure of air, or other fluid, within the inflatable bladder. An on-board inflation mechanism, i.e., an inflation mechanism incorporated directly into or onto a shoe, is particularly convenient and allows the wearer to change the pressure within the inflatable bladder without having to carry around a removable inflation mechanism.

Such on-board inflation mechanisms may be accessible to the wearer from the exterior of the shoe, such that the wearer can manually actuate the inflation mechanism when a pressure increase in the shoe is desired. Alternatively, such an on-board inflation mechanism may be positioned beneath a wearer's foot, so that the downward pressure from the foot with each step automatically actuates the inflation mechanism.

One challenge with on-board inflation mechanisms is providing simplified structures for the pump and valve for inflating the bladder.

BRIEF SUMMARY OF THE INVENTION

An embodiment of the present invention is a pump and valve combination for an inflatable article comprising: a top film; a bottom film; a pumping area between said top and bottom films; an air intake located in said pumping area; a conduit leading from said pumping area; and a flow restrictor located in a pathway of said conduit. The pump and valve combination has a first state wherein the flow restrictor limits air flow through the conduit and a second state wherein the conduit expands to allow air to flow from the pumping area above and/or below the flow restrictor.

Another embodiment of the present invention is a pump and valve combination for an inflatable article comprising: a top film; a bottom film; a first grommet; a pumping area defined by said top and bottom polymeric films and said first grommet; an air intake located in said pumping area; an exhaust hole located in said first grommet wherein air from said pumping area exits through said exhaust hole; and a flexible band arranged about said first grommet including the area with said exhaust hole. The pump and valve combination has a first state wherein the flexible band limits air flow through the exhaust hole and a second state wherein the flexible band expands to allow air to escape from the exhaust hole.

In a further embodiment, a second grommet encircles a first grommet. The space between the first grommet, the second grommet, the top film and the bottom film forms an interim chamber. The second grommet has an exhaust hole for allowing air to flow from the interim chamber into an inflatable bladder and a flexible band arranged about the second grommet including the exhaust hole. This arrangement allows for a piston like action in the pumping area.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
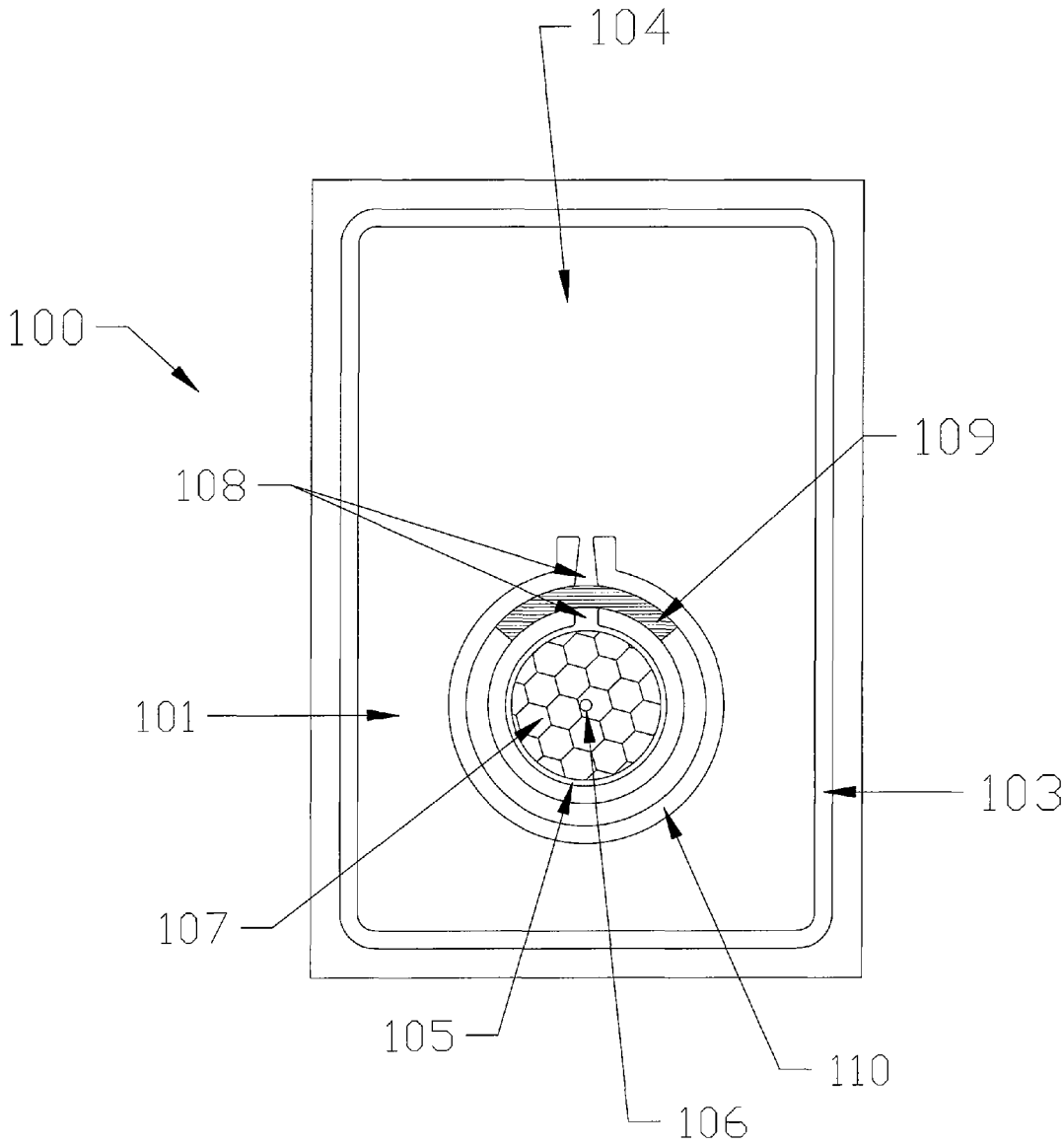
FIG. 1 is a top plan view of a pump and valve combination with a flow restrictor located in a pathway of a conduit leading from a pumping area to an inflatable bladder.

The present invention will be described with reference to the accompanying drawings. The drawing in which an element first appears is typically indicated by the leftmost digit (s) in the corresponding reference number.

While specific configurations and arrangements are discussed, it should be understood that this is done for illustrative purposes only. A person skilled in the pertinent art will recognize that other configurations and arrangements can be used without departing from the spirit and scope of the present invention. It will be apparent to a person skilled in the pertinent art that this invention can also be employed in a variety of other applications.

The present invention is directed to a pump and valve combination for an article of footwear incorporating an inflatable bladder. An article of footwear includes a sole and an upper, at least one of which comprises an inflatable bladder. The inflatable bladder is inflated with a pump and valve combination of the present invention. The pump and valve combination can comprise an on-board pump or an underfoot pump. An on-board pump is located on a portion of the upper or sole and permits the wearer to manually actuate the pump to inflate the bladder. An underfoot pump is located in the sole, preferably at the heel portion of the article of footwear, and pumps when the wearers foot presses down on the pump, thereby inflating the bladder.

A first embodiment of the pump and valve combination of the present invention is shown generally at 100 in FIG. 1. As shown in FIG. 1, a top film 101 and a bottom film (not shown)

are welded together to form a peripheral seal 103 that defines an inflatable bladder 104. Preferably top and bottom films are polymeric films, but may be other materials as would be apparent to one skilled in the art. A pumping area 105 is located between the top and bottom films having an air intake 106 and a collapsible foam insert 107 located therein. Preferably the air intake 106 is a hole in one of the top and bottom films, and most preferably is a hole in the top film 101, but the air intake may take other forms as would be apparent to one skilled in the art. There is also a conduit 108 leading from the pumping area 105 to the inflatable bladder 104 with a flow restrictor 109 located in the pathway of the conduit 108. Preferably, in the regions of the pumping area 105 not containing the collapsible foam insert 107, the conduit 108 or the flow restrictor 109, the top and bottom films are welded together to form an interior weld or seal 110 and separate pumping area 105 from the remainder of inflatable bladder 104. In this manner, pumping area 105 is monolithic with inflatable bladder 104. Alternatively, pumping area 105 may be formed independent of the inflatable bladder and a tube or the like may be connected between conduit 108 and an inlet of an inflatable bladder.

The operation of the pump and valve combination 100 will be described with reference to FIG. 1. The pumping area 105 has a first state that limits air flow into the inflatable bladder 104 and a second state that does not limit air flow into the inflatable bladder 104. In the first state, the air intake 106 is uncovered and allows air to enter and fill the pumping area 105. Flow restrictor 109 substantially seals the pumping area 105 to limit air flow from the pumping area 105 to the inflatable bladder 104. In the second state, the air intake 106 is covered (such as by a user's thumb) and the pumping area 105 is depressed, which causes the conduit 108 to expand thereby separating the top and bottom films from the flow restrictor 109 allowing air to flow from the pumping area 105 through the conduit 108, above and/or below the flow restrictor 109 and into the inflatable bladder 104, thereby inflating the bladder. When the pressure on the pumping area 105 is released and air intake hole 106 is uncovered, air flows back into the pumping area 105 through the air intake 106 and the conduit 108 retracts such that the pumping area 105 returns to the first state.

Top and bottom films may be vacuum formed to create the pumping area 105. The pumping area 105 is preferably vacuum formed into the top and bottom films to correspond to the dimensions of the collapsible foam insert 107. The top and bottom films may also be vacuum formed to create the conduit 108. Preferably, one of the top and bottom films is textured to prevent it from adhering to the other of the top and bottom films in order to facilitate air flow and inflation of the inflatable bladder 104.

Figure 2:
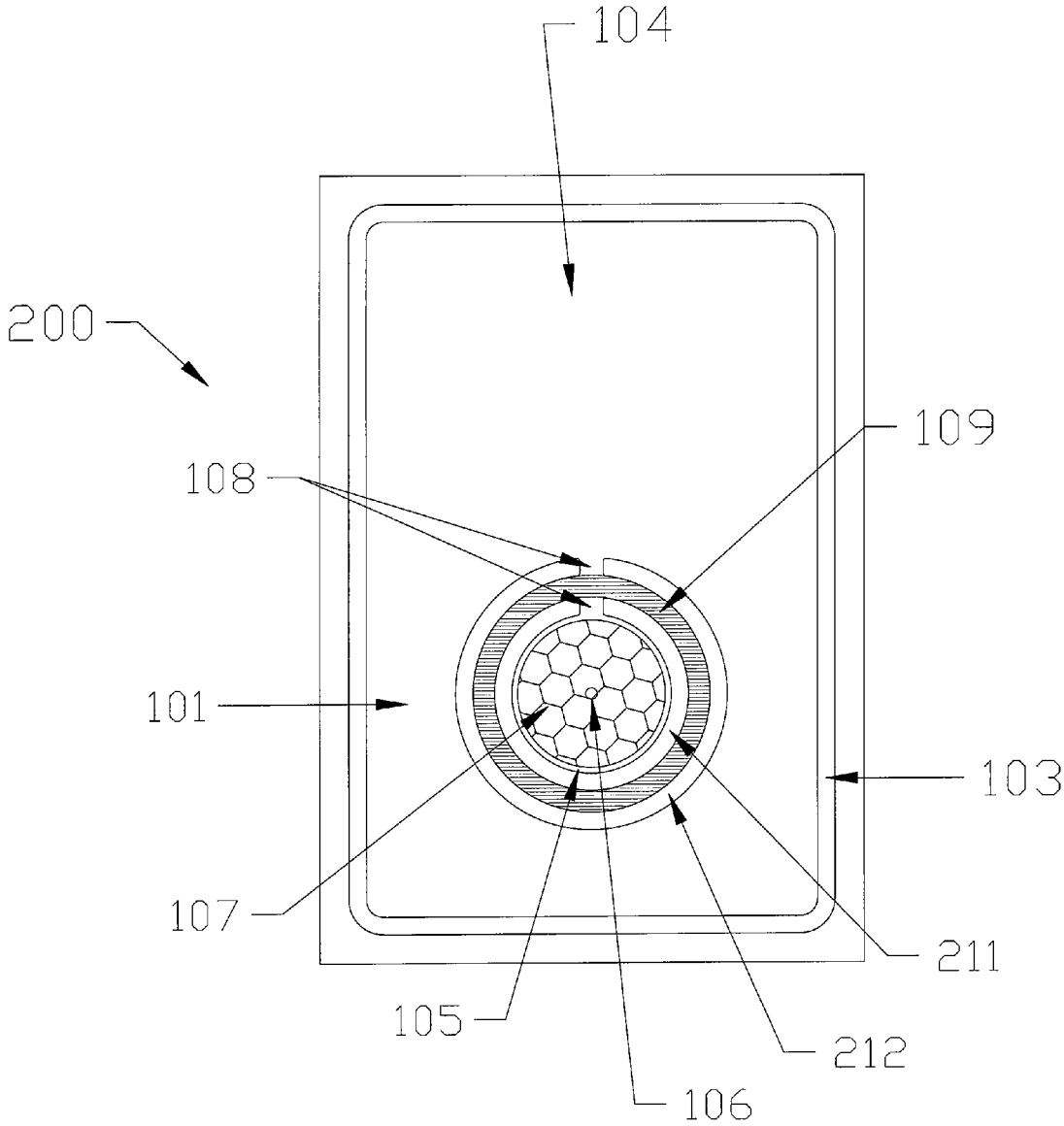
FIG. 2 is a top plan view of an pump and valve combination that is an alternative to the pump and valve combination of FIG. 1.

Preferably, the flow restrictor 109 is a portion of an flexible O-ring as depicted in FIG. 1 or as depicted in FIG. 2 in pump and valve combination 200, the flow restrictor 109 can be an O-ring in its entirety. Alternatively, the flow restrictor can be other materials and shapes as apparent to one skilled in the art that act to limit the air flow through the conduit 108 from the pumping area 105 to the inflatable bladder 104. When the flow restrictor 109 is an entire O-ring, it encircles the collapsible foam insert 107. In addition, the top and bottom films may be vacuum formed to provide a groove for the O-ring. Also when the flow restrictor 109 is an entire O-ring, a region 211 between the foam insert 107, the conduit 108 and the flow restrictor 109 is welded together except through conduit 108. Similarly a region 212 surrounding the flow restrictor 109, not including the conduit 108, is also welded together. A portion of region 211 and region 212 are not welded together, in order to form conduit 108.

Figure 3:
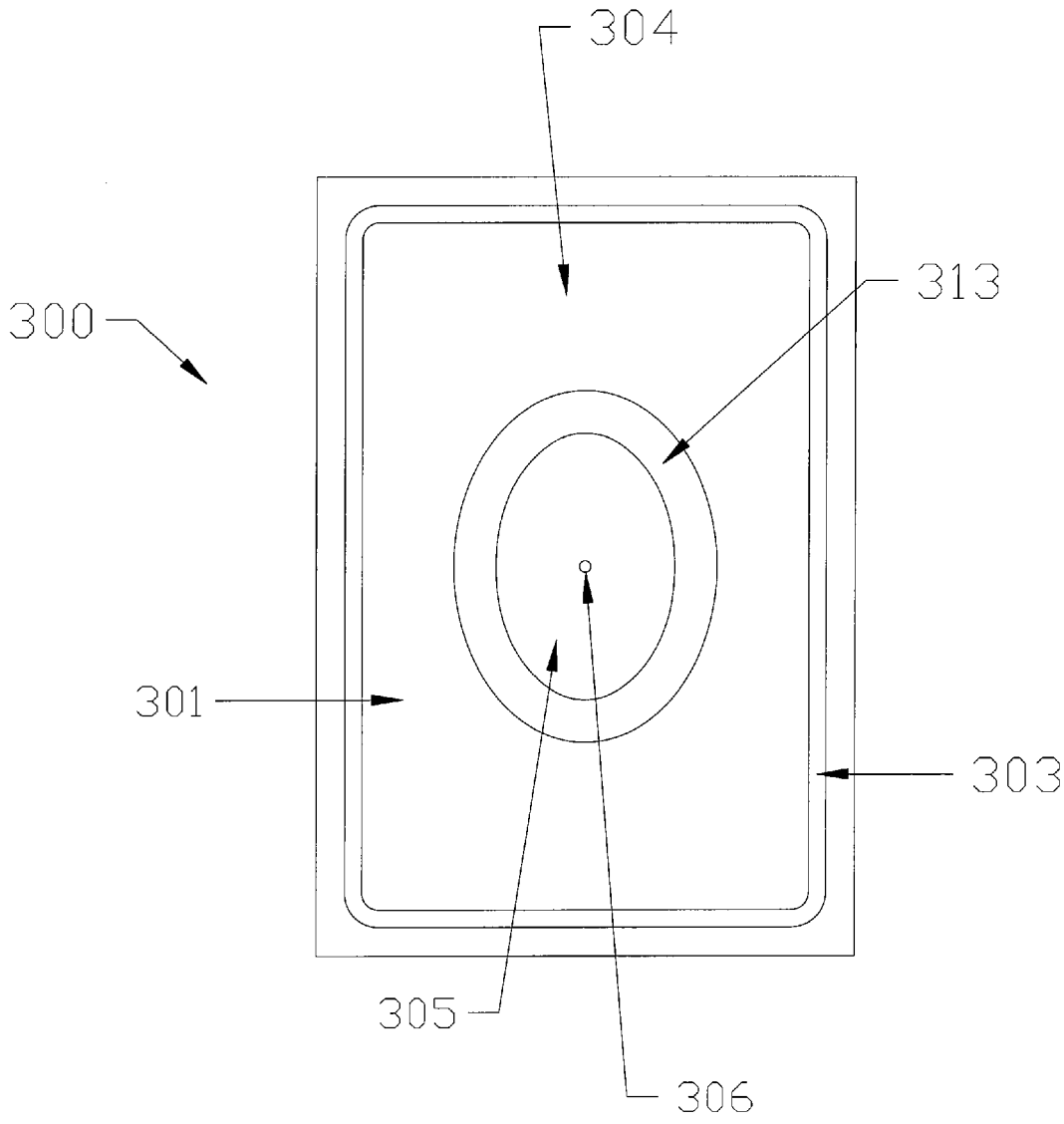
FIG. 3 is a top plan view of a pump and valve combination with a grommet.
Figure 4:
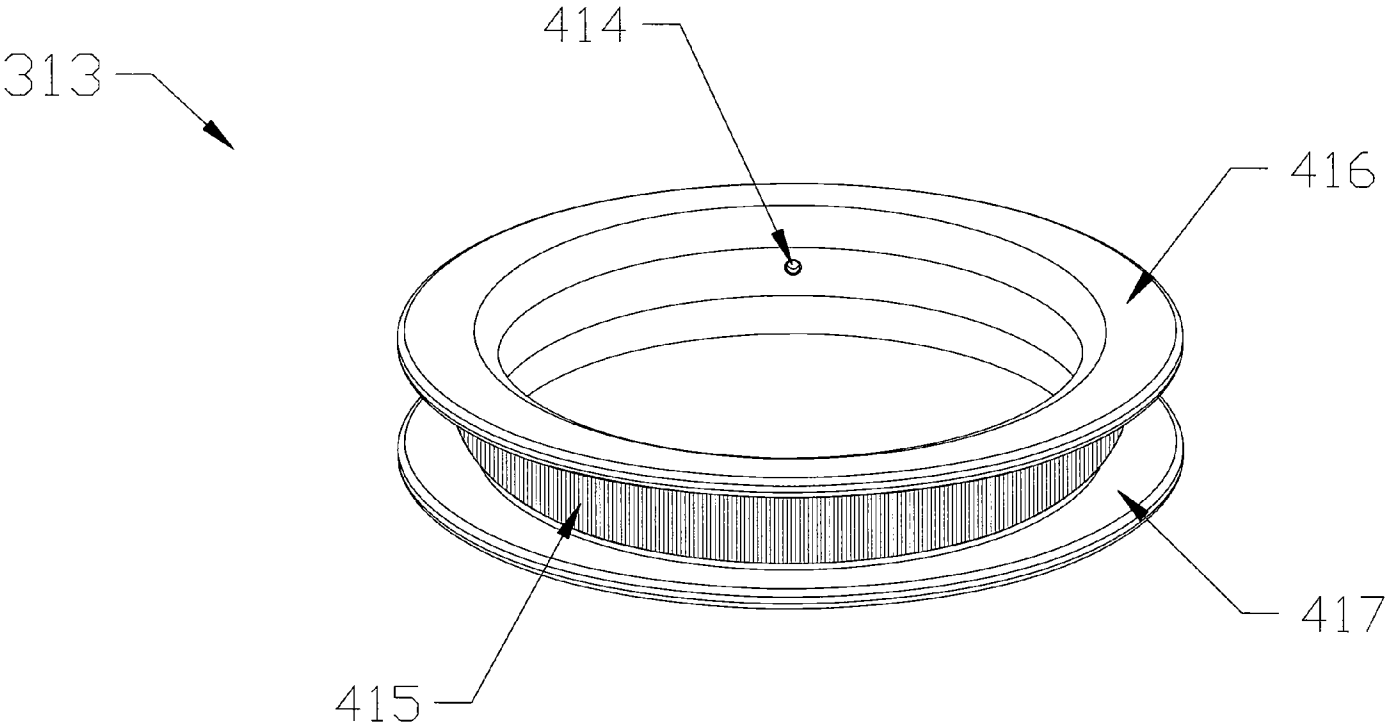
FIG. 4 is a view of the grommet in the pump and valve combination of FIG. 3.

A second embodiment of the pump and valve combination of the present invention is shown generally at 300 in FIG. 3. As shown in FIG. 3, pump and valve combination 300 has a top film 301 and a bottom film (not shown) welded together to form a peripheral seal 303 that defines an inflatable bladder 304. Preferably the top and bottom films are polymeric films, but may be other materials as would be apparent to one skilled in the art. A pumping area 305 is defined between the top and bottom films by a first grommet 313. The pumping area 305 has an air intake 306. Preferably the air intake 306 is a hole in one of the top and bottom films and most preferably is a hole in the top film 301, but the air intake may take other forms as would be apparent to one skilled in the art. As shown in FIG. 4, there is also an exhaust hole 414 in the first grommet 313 leading from the pumping area 305 to the inflatable bladder 304. A flexible band 415 is arranged about the first grommet 313 including the exhaust hole 414. The pumping area 305 may also have a compressible foam insert located therein between the top and bottom films.

The operation of the pump and valve combination 300 will be described with reference to FIG. 3. The pumping area 305 has a first state that limits air flow into the inflatable bladder 304 and a second state that does not limit air flow into the inflatable bladder 304. In the first state, the air intake 306 allows air to enter and fill the pumping area 305 when it is uncovered and the flexible band 415 substantially seals the exhaust hole 414 to limit air flow from the pumping area 305 to the inflatable bladder 304. In the second state, the air intake 306 is covered and the pumping area 305 is depressed. The increase of pressure causes the flexible band 415 to expand to uncover the exhaust hole 414, thereby allowing air to flow from the pumping area 305 through the exhaust hole 414 and into the inflatable bladder 304, thereby inflating the bladder. When the pressure on the pumping area 305 is released, air flows back into the pumping area 305 through the air intake 306 and the flexible band 415 retracts to cover the exhaust hole 414 such that the pumping area 305 returns to the first state.

Figure 5:
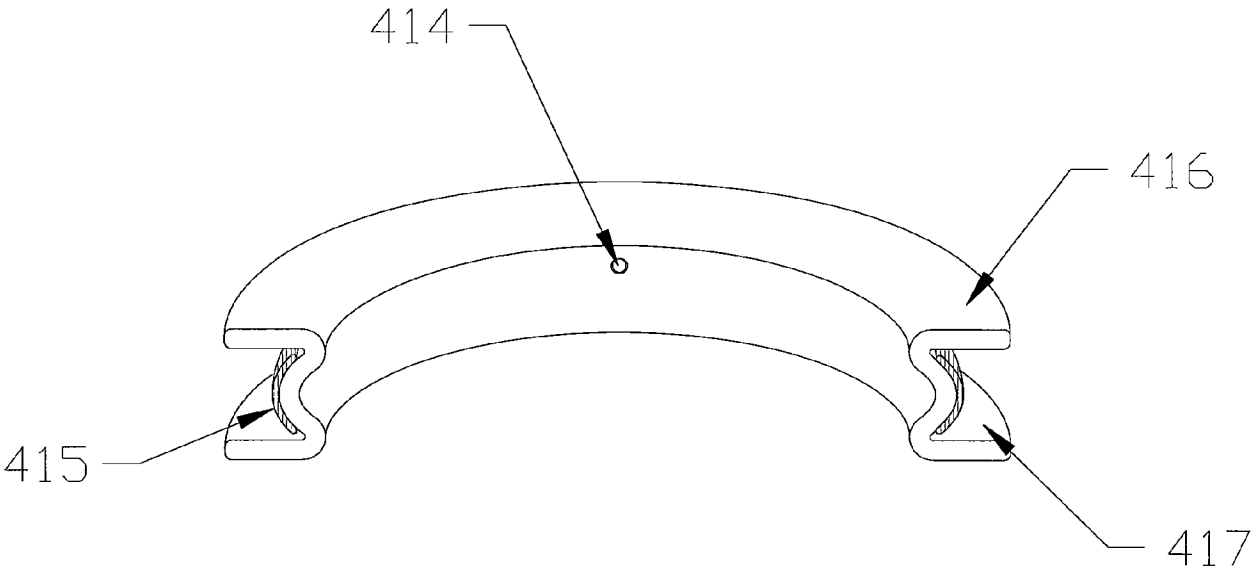
FIG. 5 is a cross-sectional view of the grommet in the pump and valve combination of FIG. 3.

The grommet 313 is preferably made from a compressible material such that when pressure is exerted on the grommet 313 it will compress. Preferably the grommet is thermoplastic polyurethane (TPU), but it may be other materials as would be apparent to one skilled in the art. In addition, the grommet 313 is preferably injection molded, however other methods may be utilized for forming it as would be apparent to one skilled in the art. In addition, the grommet has a top flange 416 and a bottom flange 417. The top and bottom films are welded to the flanges 416, 417 of the grommet 313 to form the pumping area 305. Also, as illustrated in FIG. 5, the area of the grommet 313 between the flanges 416, 417 curves outward such that the grommet 313 will buckle outward when compressed.

Figure 6:
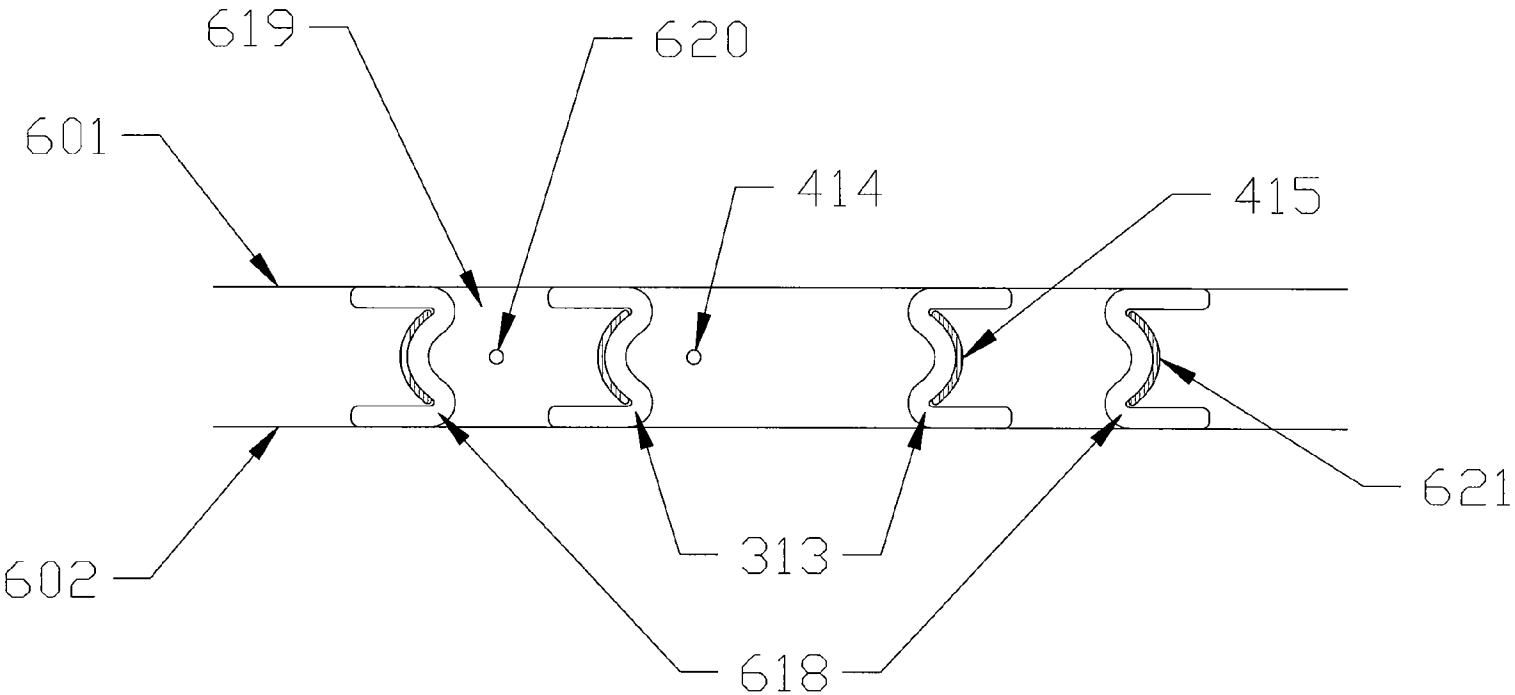
FIG. 6 is a cross-sectional view of a pump and valve combination that is an alternative to the pump and valve combination of FIG. 3.

In a further embodiment, as depicted in FIG. 6, a second grommet 618 encircles grommet 313. The space between first grommet 313, second grommet 618, top film 601 and bottom film 602 forms an interim chamber 619. The second grommet 618 has an exhaust hole 620 for allowing air to flow from the interim chamber 619 into the inflatable bladder 304. This arrangement allows for a piston like action in pumping area 305. The second grommet 618 may have a flexible band 621 arranged about it including the exhaust hole 620. The flexible bands 415, 621 may be plastic material of different durometers and the exhaust holes 414, 620 may be of different sizes in order to facilitate the piston action.

It is noted that all of the above mentioned embodiments can have a plurality of pump and valve combinations connected to a single inflatable bladder or a single pump and valve combination connected to a plurality of inflatable bladders. In the case of a plurality of pump and valve combinations having grommets, the durometer of each flexible band and the size of each exhaust hole can vary between the plurality of pump and valve combinations. Also all of the above mentioned embodiments can be incorporated into a manually inflatable on board pump or a self-inflatable pump, such as an underfoot pump, in an article of footwear.

The foregoing description of the specific embodiments will so fully reveal the general nature of the invention that others can, by applying knowledge within the skill of the art (including the contents of the references cited herein), readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

What is claimed is:

1. A pump and valve combination for an inflatable article comprising:

a top film;

a bottom film;

a pumping area defined between said top and bottom films;

an air intake located in said pumping area;

a conduit leading from said pumping area; and a flow restrictor located in a pathway of said conduit, wherein said flow restrictor is an O-ring;

wherein said pump and valve combination has a first state wherein said flow restrictor limits air flow through said conduit and a second state wherein said flow restrictor expands to allow air to flow from said pumping area through (a) an area above said flow restrictor and below said top film and/or (b) an area below said flow restrictor and above said bottom film.

2. The pump and valve combination of claim 1, further comprising an inflatable bladder defined by a sealed area between said top and bottom films outside of said pumping area.

3. The pump and valve combination of claim 1, wherein said top and bottom films are formed of a polymeric material.

4. The pump and valve combination of claim 1, wherein one of said films is textured.

5. The pump and valve combination of claim 1, wherein the pump and valve combination is for an inflatable article incorporated in an article of footwear.

6. The pump and valve combination of claim 1, wherein said air intake is a hole in one of said films.

7. The pump and valve combination of claim 1, further comprising a compressible foam insert located within said pumping area.

* * * * *